United States Patent [19]

Matthews

[11] 4,321,030

[45] Mar. 23, 1982

[54] FUEL IGNITION AND STACK DAMPER CONTROL CIRCUIT

[75] Inventor: Russell B. Matthews, Tuscon, Ariz.

[73] Assignee: Johnson Controls, Inc., Milwaukee, Wis.

[21] Appl. No.: 130,141

[22] Filed: Mar. 13, 1980

[51] Int. Cl.[3] ..... F23H 3/00

[52] U.S. Cl. ..... 431/20; 236/1 G

[58] Field of Search ..... 431/20, 22; 236/1 G, 236/45; 110/163; 126/285 B, 286

[56] References Cited

U.S. PATENT DOCUMENTS

| | | | |
|---|---|---|---|
| 2,155,642 | 4/1939 | Dewey | 236/1 G |
| 4,084,743 | 4/1978 | Matthews et al. | 236/1 G |
| 4,087,045 | 5/1978 | Matthews | 236/1 G |
| 4,189,296 | 2/1980 | Hayes | 431/20 |
| 4,204,833 | 5/1980 | Kmetz et al. | 431/22 |
| 4,239,477 | 12/1980 | Hayes | 431/20 |
| 4,254,759 | 3/1981 | Schmidt | 236/1 G X |

*Primary Examiner*—Edward G. Favors

*Attorney, Agent, or Firm*—Emrich, Root, Lee, Brown & Hill

[57] ABSTRACT

A control circuit for a fuel supply and ignition control system controls the operation of pilot and main valves of the system and of a motor which controls the positioning of a vent stack damper plate to normally close the vent stack and to open the vent stack at the start of each ignition cycle. At the start of each ignition cycle, a start relay is operated to energize the pilot valve and a spark generator for a trial for ignition interval defined by the excursion time of the damper plate as it is driven to the open position. When the pilot fuel is ignited, a flame sensing circuit operates a flame relay which completes a holding path for the pilot valve and when the damper plate reaches the fully open position, limit switches connect the main valve to the holding path and deenergize the drive motor and the start relay. If a pilot flame is not sensed before the end of the trial for ignition period, one of the limit switches deenergizes the pilot valve, and the start relay prevents reenergization of the drive motor, locking out the system. The control circuit includes a relay checking arrangement whereby start-up is prevented if for any reason the flame relay is operated at the start of an ignition cycle.

17 Claims, 2 Drawing Figures

FUEL IGNITION AND STACK DAMPER CONTROL CIRCUIT

BACKGROUND OF THE INVENTION

1. Field of the Invention

This invention relates to heating systems including an automatically controlled stack damper apparatus, and, more particularly, to a control circuit which provides fail-safe operation of the stack damper apparatus and the fuel ignition and supply apparatus for such systems.

2. Description of the Prior Art

Heating systems employing furnaces having fuel-fired burners require a vent stack to conduct combustion products away from the burner. Many such systems, include an automatically controlled stack damper which permits the vent stack to be closed to minimize heat losses when the furnace is not operating, and to open the vent at the start of each heating cycle. To insure that the stack damper is open in advance of each operation of the burner, systems in which automatic dampers are used generally include an interlock arrangement between the damper control mechanism and fuel supply and ignition apparatus of the system which requires that the damper be fully open before the burner operates.

In one known arrangement in which a primary burner control is conditional on and subsequent to the opening of a stack damper, a drive motor is energized in response to a request for heat and drives the damper to an open position. Limit switches complete the burner circuit and deenergize the drive motor. The motor is energized at the end of the heat run to move the damper to the closed position, and a further limit switch deenergizes the motor when the damper reaches the closed position. Movement of the damper away from its fully open position permits a limit switch to operate and interrupt the burner circuit.

Although such systems prevent operation of the fuel supply apparatus unless the vent stack is open, and maintain the system locked out under certain failure conditions, due to the interlock arrangement, the system may also be locked out following a flame out or a momentary power interruption, an undesirable condition.

A further consideration is that in systems which employ proven pilot type fuel supply apparatus, it is desirable that the pilot valve be deenergized if the pilot fuel fails to be ignited within a predetermined time, commonly referred to as a trial for ignition interval. In one known arrangement, the trial for ignition interval is defined by an electronic timer circuit which controls a solid state switch to effect the deenergization of the pilot valve if a pilot flame fails to be sensed before the end of the trial for ignition interval. However, should the solid state switch fail, the pilot valve will remain operated after the trial for ignition interval, defeating the function of the trial for ignition timer.

SUMMARY OF THE INVENTION

The present invention provides a control circuit for a fuel supply and ignition control system of the intermittant pilot type. The control circuit controls the operation of the pilot and main fuel supply valves of the system and positioning of a vent stack damper plate which normally positioned to close the vent stack, but is repositioned to open the stack to vent combustion products away from the burner apparatus during operation of the system.

At the start of each operating cycle, the stack damper drive motor is energized and drives the damper plate from the closed position to the open position. The pilot valve and a spark generating circuit are also energized at start-up for a trial for ignition interval defined by the excursion time of the damper plate as it is driven from the closed position to the open position. If ignition fails to occur during the trial for ignition period, then a limit switch, which is operated as the damper plate approaches the fully open position, interrupts the pilot valve energizing path so that the pilot valve closes. This results in total shut-off of fuel to the burner apparatus.

In normal operation, the pilot fuel is ignited before the damper plate reaches the fully open position, and a flame sensing circuit senses the pilot flame and operates a flame relay which completes a holding path for the pilot valve to maintain it operated. When the damper plate reaches the fully open position, a limit switch operates to connect the main valve to the holding path for energization and a further limit switch operates to deenergize the drive motor to maintain the damper plate open. The stack damper drive motor is also energized over a path including further normally closed contacts of the flame relay.

In accordance with a feature of the invention, the flame sensing circuit is energized continuously and independently of control contacts which close to activate the control circuit at the start of an ignition cycle. Accordingly, any fault of the flame sensing circuit, or a welded contact failure of the flame relay will manifest itself by causing the system to go to a lockout state at the start of the next ignition cycle.

A flameout during a heat run will result in the fuel valves being shut off and the damper plate being driven to the closed position. When the damper plate reaches the closed position, a new trial for ignition cycle is initiated. Similarly, for a momentary power interruption during a heating cycle, then when power is restored, the damper plate is cycled closed, with the fuel valves deenergized, and a retry for ignition is initiated. In either case, the system is limited to one re-try for ignition, and if the pilot fuel is not ignited during such interval, the system is locked out.

The lockout function is provided by a start relay which is energized at the start of each ignition cycle and operates to complete the energizing path for the pilot valve and to interrupt the return drive path for the drive motor. Under normal conditions, the start relay is deenergized when the damper plate reaches the fully open position, if the flame relay was previously operated. However, should the flame relay fail to operate before the end of the trial for ignition period, then the start relay is maintained operated preventing reenergization of the drive motor as long as the control circuit is activated.

In summary, during each ignition cycle, the trial for ignition interval is defined by the excursion time of the damper plate as it is driven from the closed position to the open position. If a pilot flame fails to be sensed before the end of the trial for ignition interval, the pilot valve is deenergized, providing total shut-off of fuel supply to the burner apparatus, and the start relay will maintain the system in a lock out state as long as the control circuit is activated.

The control circuit provides fail-safe operation for virtually any fault condition, including welded contact failure for the control relays and limit switches of the circuit. A relay checking arrangement prevents start-up for a fault condition in the flame sensing circuit or the flame relay. Also, a fault in the flame sensing circuit which allows the flame relay to operate while the system is locked out, does not affect system safety. That is, for such fault condition, the damper plate will be driven closed, and subsequent start-up will be prevented since the flame relay will be operated. However, the system will recycle following a flameout or a momentary power interruption, with the start relay or a momentary power interruption, with the start relay limiting the system to only one re-try for ignition before causing the system to be locked out.

DESCRIPTION OF A PREFERRED EMBODIMENT

Figure 1:
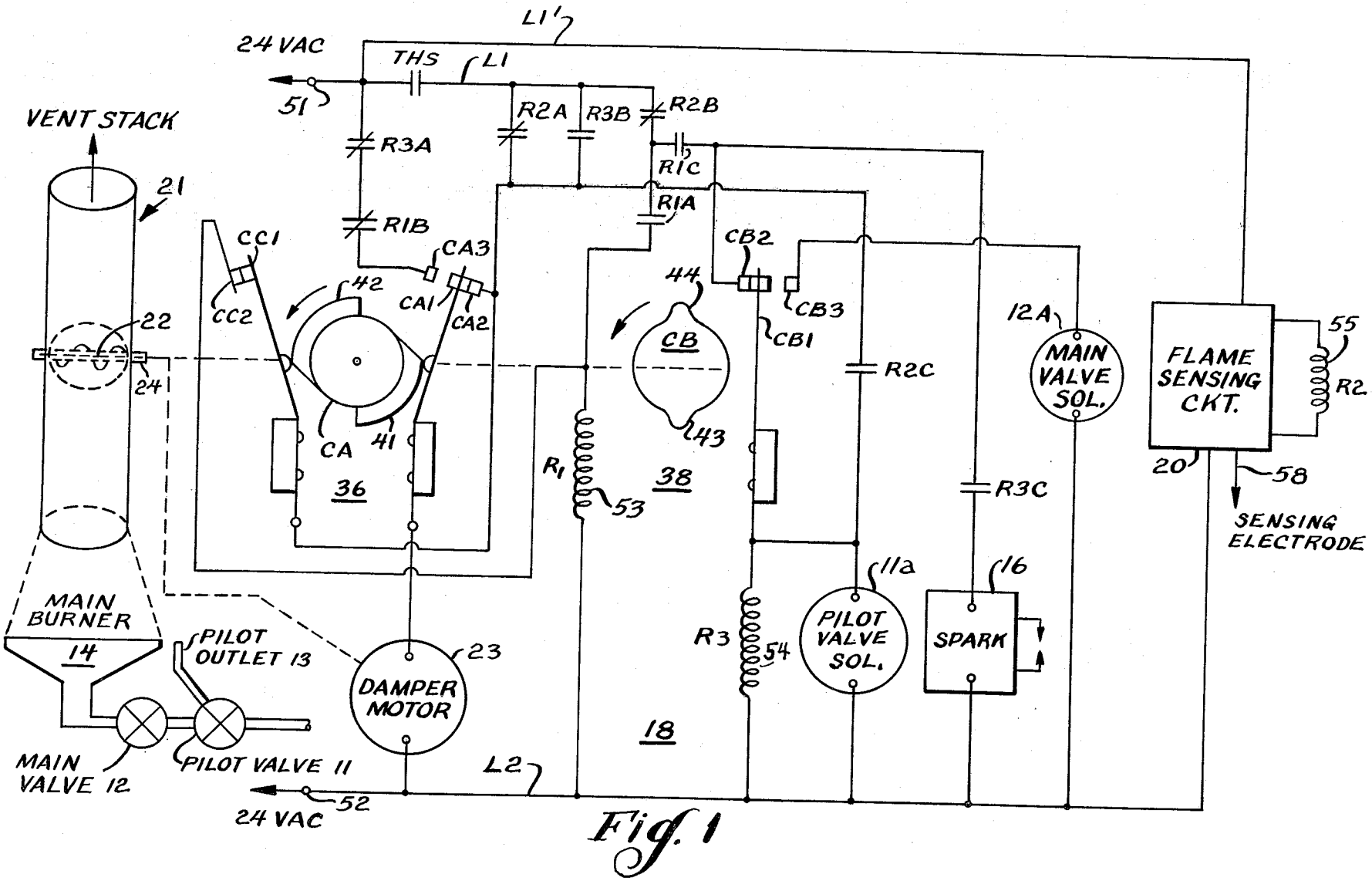
FIG. 1 is a schematic circuit diagram of a control circuit for a fuel supply and ignition control system provided by the present invention; and, FIG. 2 is also a schematic circuit diagram of the control circuit shown in FIG. 1, but with the contact layout rearranged to more clearly illustrate the control paths provided by the various contacts.

Referring to FIG. 1 of the drawings, the heating system is of the pilot ignition type and includes a fuel-fired heating apparatus having a pilot valve 11 which supplies fuel to a pilot outlet 13 and a main valve 12 which supplies fuel to a main burner 14. The pilot valve 11 and main valve 12 are connected in a redundant configuration by which fuel is supplied to the inlet of the main valve through the pilot valve 11, so that the supply of fuel to the main valve 12 is interrupted whenever the pilot valve 11 is closed. The fuel supplied to the pilot outlet 13, when the pilot valve 11 is open, is ignited by sparks provided by a spark generating circuit 16 to provide a pilot flame. The fuel supplied to the main burner 14, when the main valve 12 is operated, is ignited by the pilot flame to establish a flame at the main burner 14 providing heat for the system.

A vent stack 21 is provided to vent combustion products away from the main burner. A motor driven damper plate 22, which is mounted within the vent stack 21, is normally maintained in a position to close the vent stack preventing heat loss via the vent stack 21 when the heating system is shut down. In response to a request for heat, the damper drive motor 23 is energized and drives the damper plate 22 to the open position, represented by the dashed lines in FIG. 1, and when the heating demand has been met, the damper drive motor 23 returns the damper plate 22 to the closed position to reclose the vent stack.

The operation of the pilot valve 11, the main valve 12, the stack damper drive motor 23 and the spark generating circuit 16 are controlled by a control circuit 18 which includes a start relay R1, a flame relay R2, which is controlled by a flame sensing circuit 20, and a checking relay R3. The control circuit 18 also includes a pair of limit switches 36 and 38 which are mechanically linked to the shaft 24 of the motor 23 and are operated as the motor drives the damper plate between its open and closed positions.

The start relay R1 controls the operation of the pilot valve and the spark generating circuit at the start of each ignition cycle, and disables the spark generating circuit if a pilot flame is established before the damper plate is driven fully open. In accordance with one aspect of the invention, the excursion time of the stack damper plate, as it is driven from the closed to open position, defines the trial for ignition time for the system. The excursion time is in the order of thirty seconds. If for any reason a pilot flame fails to be sensed before the damper plate reaches the fully open position, the pilot valve is deenergized and the system is locked out when the limit switches 36 and 38 are operated.

Should a pilot flame fail to be established before the damper plate reaches the fully open position, then the flame relay R2 is unoperated, and relay R1 remains energized via its contacts R1A and contacts R2B. Thus, contacts R1B are kept open, preventing reenergization of the drive motor so that the damper plate remains in the open position, and the fuel valves are kept deenergized because contacts R2C are open.

In accordance with another aspect of the invention the flame relay R2 has respective normally closed contacts R2A and R2B connected in the energizing paths for the damper drive motor 23 and the pilot valve solenoid 11A. If for any reason contacts R2A and R2B are open at start-up, the system will go to a lock out condition. The relay R2 also provides a holding path for the pilot valve solenoid via normally open contacts R2C if a pilot flame is established before the damper plate is driven fully open. The checking relay R3 is operated at the start of each ignition cycle and via its contacts R3B prepares a holding path for the pilot valve solenoid 11A. The contacts R3B are connected in parallel with flame relay contacts R2A and provide a checking function in that if contacts R2A are open at start-up the system is locked out because, the energizing paths for the drive motor 23 and the start relay are interrupted. Also, continuation of an ignition cycle is predicated on the operation of the checking relay R3 before the flame relay R2 operates because relay R1 will drop out, and relay R3 cannot energize unless relay R1 is operated.

The cam operated switch 36 controls the energization and deenergization of the damper drive motor 23. The limit switch 36 via its contacts CA1–CA2 provide an energizing path for the damper drive motor 23 which path is interrupted when the damper plate has been driven to its fully open position. Contacts CA1–CA3 provide a return drive path for the motor to return the damper plate to its closed position following the termination of a heating cycle. Contacts CC1–CC2 of limit switch 36 effect disabling of the start relay R1 following a successful ignition cycle. The limit switch 38 controls the operation of the fuel valves and has its contacts CB1–CB2 connected in the energizing path for the pilot valve solenoid 11A and its contacts CB1–CB3 operated, when the damper reaches the fully open position, to connect the main valve solenoid 12A to the pilot valve solenoid holding path.

Briefly, in operation when thermostatically controlled contacts THS close at the start of an ignition cycle, the start relay R1 is operated and effects energization of the spark generating circuit 16, the checking relay R3, and the pilot valve solenoid 11A. When the pilot valve operates, fuel is supplied to the pilot outlet 13 for the ignition by the sparks provided by the spark generating circuit 16. The damper drive motor 23 is also energized over a path including normally closed contacts R2A of the flame relay and contacts CA1–CA2 of limit switch 36 which are closed when the damper plate is in the closed position. When the damper motor 23 is energized, the motor shaft 24 drives the damper plate 22 from the closed position towards the open position.

Normally, the pilot fuel is ignited, before the damper plate reaches the fully open position, and the flame sensing circuit 20 senses the pilot flame and operates the flame relay R2 which opens its contacts R2B interrupting the pilot valve solenoid energizing path. However, contacts R2C close to maintain the pilot valve solenoid energized over a path including contacts R3B of the checking relay R3.

When the damper plate 22 reaches the fully open position, limit switch 36 operates and contacts CA1--CA2 open deenergizing the damper drive motor 23 and contacts CC1-CC2 open deenergizing the start relay R1. When the start relay drops out, its contacts R1C open deenergizing the spark generator 16. Contacts CB1-CB3 of limit switch 38 close to connect the main valve solenoid 12A to the pilot valve holding path for operating the main valve. If a pilot flame fails to be sensed before contacts CB1-CB2 open, then the energizing path for the pilot valve solenoid is interrupted causing the pilot valve to close and shut off the supply fuel to the pilot outlet.

When contacts THS open at the end of a successful ignition cycle, the fuel valves are deenergized and relay R3 drops out completing a return drive path for the damper motor 23 when then returns the damper plate to the close position. When the damper plate reaches the close position, contacts CA1-CA3 of limit switch 36 open, deenergizing the drive motor.

DETAILED DESCRIPTION

Considering the control circuit in more detail, power is supplied to the control circuit over input terminals 51 and 52 thereof which are connectable to a 24 VAC source. Terminal 51 is connected over normally open thermostatically controlled contacts THS to a conductor L1, and terminal 52 is connected directly to a further conductor L2.

The limit switches 36 and 38 each comprise cam actuated switches, the operation of which is controlled by way of cams CA and CB. The cams CA and CB are mechanically linked to the shaft 24 of the motor 23. The limit switch 36 includes a resilient switch arm CA1, which is movable by way of cam CA, and a pair of fixed contacts CA2 and CA3. Cam actuator portions 41 and 42 are disposed at opposed positions along the periphery of the cam CA. As shown in FIG. 1, for switch 36 which controls the energization of the drive motor 23, actuator portion 41 maintains switch arm CA1, which is biased to normally engage contact CA3, in engagement with contact CA2 completing a portion of the energizing path for drive motor 23 when the damper plate 22 is in the closed position. When the motor is energized at the start of a heating cycle, the cam CA is rotated counterclockwise and when the cam CA is rotated approximately 90°, the actuator portion 41 disengages the switch arm CA1 which then moves out of engagement with contact CA2 and into engagement with contact CA3 deenergizing the motor and completing a portion of the return drive path for the motor 23. When the motor is reenergized at the end of the heating cycle, the cam CA is again driven counterclockwise and when cam CA has been rotated through another 90°, actuator portion 42 engages the switch arm CA1, moving the switch arm CA1 out of engagement with contact CA3 and into engagement with contact CA2, interrupting the motor return drive path.

Cam switch 36 also includes resilent switch arm CC1 which engages contact CC2, completing a portion of the energizing path for the operate winding 53 of the start relay R1 when the damper place 22 is in the closed position. Contacts CC1 and CC2 are opened, interrupting the energizing path for winding 53 when the damper plate 22 is in the open position.

Similarly, limit switch 38, which controls the valve operation, includes a resilient switch arm CB1, which is movable by cam CB, and fixed contacts CB2 and CB3. Cam CB has cam actuator portions 43 and 44, which are normally disengaged from the switch arm C1B permitting the switch arm CB1 to engage contact CB2 when the damper plate 22 is in the closed position. The cam actuator portion 43, for example, causes the switch arm CB1 to be moved out of engagement with contact CB2 and into engagement with contact CB3 with a few angular degrees less than 90° of rotation of the cam CB to a position corresponding to the fully open position for the damper plate 22.

Contacts CB1 and CB2 of limit switch 38 complete a portion of the energizing path for the checking relay R3 and the pilot valve solenoid 11A when the damper plate 22 is in the closed position and are operated to interrupt the pilot valve energizing path when the damper plate 22 is driven to the fully open position. Contacts CB1 and CB3 of limit switch 38 complete a portion of the energizing path for the main valve solenoid 12A when the damper plate is in the open position.

The operate winding 53 of the start relay R1 is connected in circuit with normally closed contacts CC1-CC2 of limit switch 36 and normally closed contacts R2A of the flame relay R2 between conductors L1 and L2, permitting energization of the winding 53 when contacts THS close at the start of the heating cycle. When operated, relay R1 closes its contacts R1A providing a holding path for the winding 53 over its contacts R1A and normally closed contacts R2B of the flame relay. Also, contacts R1C close connecting the pilot valve solenoid 11A and the operate winding 54 of the checking relay R3 to conductor L1 through contacts CB1-CB2 of limit switch 38 and contacts R2B.

Flame sensing circuit 20 is connected by way of conductors L1' and L2 directly to terminals 51 and 52 and is thus energized continuously and independently of the thermostatically controlled contacts THS. The flame sensing circuit 20 may, for example be similar to the one disclosed in my U.S. Patent Application Ser. No. 790,408 entitled FUEL IGNITION CONTROL SYSTEM, and which is assigned to the assignee of this application. The structure and operation of the flame sensing circuit 20 is set forth in the referenced application. For purposes of this description it is sufficient to state that in the absence of a flame, flame sensing circuit 20 maintains the flame relay R2 deenergized. When a flame impinges on the flame sensing electrode 58, the flame sensing circuit 20 effects energization of the operate winding 55 of the flame relay R2 causing the relay to operate. Flame relay R2 has normally closed contacts R2A connected in the energizing path for the damper motor 23 and the start relay R1. Further contacts R2B are connected in the energizing path for the pilot valve solenoid 11A and the operate winding 54 of the checking relay R3. In addition, normally open contacts R2C of the flame relay R2 complete the holding path prepared by contacts R3B of the checking relay between conductors L1 and L2 for the pilot valve solenoid 11A and the checking relay operate winding 54, for maintaining the pilot valve and the checking relay operated when flame relay contacts R2B open following operation of the flame relay.

The checking relay R3 has its operate winding 54 connected in circuit with cam switch contacts CB1–CB2, normally open contacts R1C of the start relay R1 and normally closed contacts R2B of the flame relay between conductors L1 and L2, permitting energization of the winding 54 when the start relay R1 operates. When operated, relay R3 closes its contacts R3C connecting the spark generating circuit 16 between conductors L1 and L2 over a path including contacts R1C and R2B. Also, contacts R3A are open, interrupting the return drive path for the damper motor 23.

The spark generating circuit 16 my be similar to one shown and described in my U.S. Pat. No. 3,902,839, which is assigned to the assignee of this application. When energized, the spark generating circuit generates high voltage pulses which are applied via ignition transformer (not shown) to the spark electrodes 17 causing sparks to be generated in the proximity of the pilot outlet 13 for igniting the pilot fuel. The spark generating circuit 16 is deenergized when contacts R3C are open.

OPERATION

The operation of the circuit 18 will be described with reference to FIG. 2 which is the same circuit as that shown in FIG. 1, but with the contact layout rearranged to more clearly illustrate the control paths provided by the various contacts. Also, in FIG. 2, contacts C3A, C2A, C2C, C2B and C3B correspond to limit switch contact pairs CA1–CA3, CA1–CA2, CC1–CC2, CB1–CB2 and CB1–CB3, respectively, shown in FIG. 1.

Figure 2:
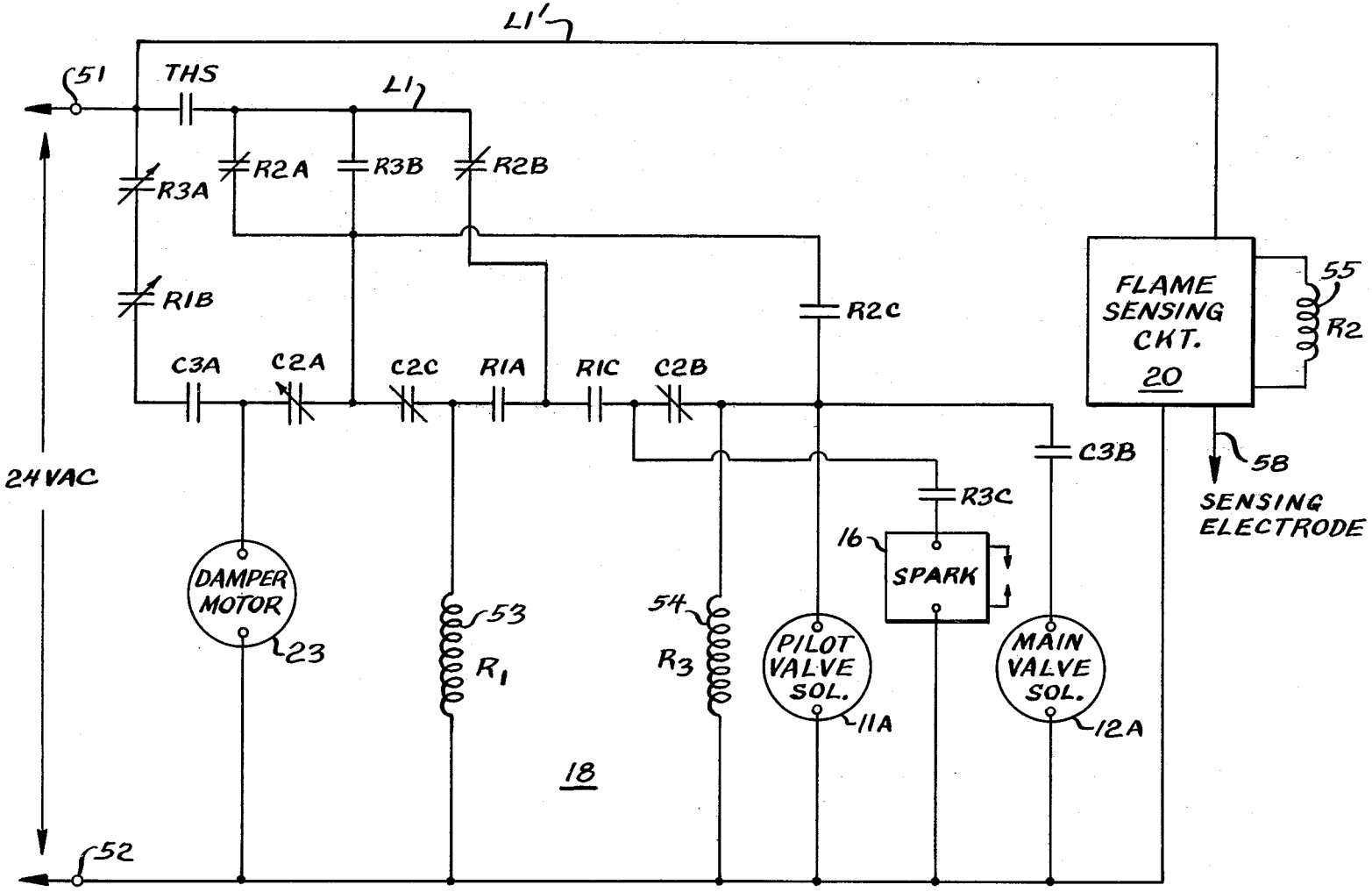

Referring to FIG. 2, when power is applied to the input terminals 51 and 52, the flame sensing circuit 20 is energized. Under normal conditions, the flame sensing circuit 20 maintains relay R2 deenergized so that contacts R2A and R2B are closed and contacts R2C are open. Also, initially the stack damper plate 22 is positioned to close the vent stack, and, cams CA and CB are in the positions illustrated in FIG. 1 so that contacts C3A and C2B are open and contacts C2A, C2C and C3B are closed.

When contacts THS close in response to a request for heat, current flows from conductor L1 through contacts R2A and C2A and through the winding of the drive motor 23 to conductor L2. The drive motor is thus energized and operates to drive the damper plate 22 towards the open position and to rotate cams CA and CB counterclockwise in the direction of arrows in FIG. 1. Current also flows from conductor L1 through contacts R2A, C2C and the operate winding of relay R1 to the conductor L2. Accordingly, the start relay R1 operates to close contacts R1A to latch the relay on through normally closed flame relay contacts R2B. Also, contacts R1C also close to complete an energizing path for the pilot valve solenoid 11A and the operate winding 54 of checking relay R3 through limit switch contacts C2B and contacts RB2. In addition, contacts R1B open, interrupting the return drive path for the drive motor 23.

When energized, relay R3 operates to close contacts R3B to latch the relay on over a path including contacts R3B, C2C, R1A, R1C and C2B; to close contacts R3C to energize the spark generating circuit 16; and to open contacts R3A, which are connected in the return drive path for the drive motor. When closed, contacts R3B shunt flame relay contacts R2A completing a portion of the holding path for the pilot valve permitting it to remain energized when contacts R2A and R2B of the flame relay open following operation of the flame relay R2 when a pilot flame is sensed.

When the pilot valve solenoid 11A is energized, the pilot valve 11 operates and supplies fuel to the pilot outlet for ignition by sparks provided by the spark generating circuit 16 which is also energized at this time. The trial for pilot ignition time is defined by the excursion time of the damper plate as it is driven from the closed position to the open position. The timing function is provided by the cam operated limit switch 38 which operates to interrupt the energizing path for the pilot valve solenoid just before the damper plate reaches the fully open position. If a pilot flame fails to be sensed before cam switch 38 operates, then the energizing paths for the pilot valve solenoid 11A and the checking relay R3 are interrupted. The pilot valve closes, interrupting the supply of fuel to the pilot outlet, and also preventing fuel from being supplied to the main valve 12, thereby providing 100% shut off of fuel supply to the burner apparatus. Also, relay R3 drops out, deenergizing the spark generating circuit 16 by opening contacts R3C, and opening contacts R3B to prevent inadvertent energization of the pilot valve should a fault occur in the flame sensing circuit, permitting relay R2 to operate. When limit switch 36 operates as the damper plate reaches the fully open position, contacts CA2 open, deenergizing the drive motor. Although contacts R3A reclosed when relay R3 dropped out, the return drive path for the motor is kept interrupted by contacts R1B which are kept open because relay R1 remains operated. The system is thus locked out with the drive motor and both fuel valves deenergized. The system remains locked out until thermostat contacts THS are opened, disconnecting power from conductors L1 and L2, which permits relay R1 to drop out and reclose contacts R1B. This causes reenergization of the drive motor which responsively drives the damper plate to the closed position.

Normally, a pilot flame is provided within the thirty second time interval as the damper is driven from the closed position to the open position. When the pilot fuel ignites, the flame sensing circuit 20 responds to the flame to energize the operate winding 55 of the flame relay R2. When relay R2 operates, contacts R2A and R2B open and contacts R2C close, connecting the pilot valve solenoid to the holding path provided over contacts R3B. The damper drive motor is maintained energized over contacts R3B and C2A when contacts R2A open, and the motor continues to drive the damper plate towards the fully open position.

A few angular degrees before the damper plate reaches its fully open position, limit switch 38 opens contacts C2B and closes contacts C3B. The pilot valve solenoid is maintained energized over a holding path provided by contacts R2C and R3B, and the main valve solenoid 12B is connected to the holding path by contacts C3B, and the main valve is operated to supply fuel to the main burner for ignition by the pilot flame.

When the damper plate reaches the fully open position, contacts C2C open to interrupt the energizing path for relay R1. This causes relay R1 to drop out and contacts R1A and R1C open deenergizing the spark generating circuit 16. Also, contacts R1B, which are connected in the return drive path for the damper motor, close. However contacts R3A are open, preventing reenergization of the drive motor at this time.

In addition, contacts C2A open, interrupting the energizing path for the damper drive motor 22 to stop the damper plate 22 at the fully open position. Also, contacts C2C close to connect the drive motor to its return drive path which is maintained interrupted at this time by contacts R3A.

Should a flameout occur following a successful ignition cycle, the flame relay R2 will drop out, opening contacts R2C deenergizing the fuel valves and relay R3. When relay R3 drops out, the damper motor is energized over contacts R3A, R1B and C3A to drive the damper plate back to the closed position. When the damper plate reaches the closed position contacts C2C, C2A and CB3 are reclosed allowing a further trial for ignition to be initiated. Thus, the system provides recycling under flameout conditions.

In the event of a momentary loss of power to the system during an operating cycle, the flame sensing circuit 20 and relay R2 are deenergized as are relay R3 and the fuel valves. Accordingly, when power is restored, a return drive path is provided for the damper motor over contacts R3A, R1B and C3A, permitting the damper plate to be cycled to the closed position to initiate a further trial for ignition cycle. It is pointed out, for a flameout or power loss condition, the start relay R1, permits only one re-try for ignition and should a pilot flame fuel to be established during such further trial for ignition, the system goes to lockout. This is because with relay R1 maintained operated, its contacts R1B interrupt the return drive path for the motor 23.

When contacts THS open after the heating demand has been met, the fuel valves are deenergized to extinguish the flame. Relay R3 is also deenergized and causes contacts R3A to close and complete the return drive path for the damper motor. The damper motor responsively drives the damper plate from the open position towards the closed position, rotating cams CA and CB further in the counterclockwise direction.

When the damper plate reaches its fully closed position, cam CA causes contacts C3A to open to deenergize the drive motor. Also contacts C2A and C3A close, and cam switch contacts C3B open and contacts C2C close to prepare the system for the next heating cycle.

Having thus disclosed in detail preferred embodiments of my invention, persons skilled in the art will be able to modify certain of the structure which has been disclosed and to substitute equivalent elements for those which have been illustrated; and it is, therefore, intended that all such modifications and substitutions be covered as they are embraced within the spirit and scope of the appended claims.

I claim:

1. In a heating system including a furnace having a fuel fired burner apparatus with a solenoid operated pilot valve operable when energized to supply fuel to a pilot output for ignition by sparks provided by a spark generator to provide a pilot flame, and a solenoid operated main valve operable when energized to supply fuel to a main burner for ignition by the pilot flame; a vent stack for venting combustion products away from said burner apparatus, and stack damper means including a stack damper plate mounted within said vent stack and movable between closed and open positions under the control of a drive motor; a control circuit for controlling the operation of said fuel valves and said drive motor comprising: activate switch means operated in response to a request for heat to energize said drive motor to cause said damper plate to be driven from its closed position to its open position; first switching means responsive to the operation of said activate switch means to energize the pilot valve solenoid and said spark generator during a trial for ignition time interval defined by the excursion time of the damper plate as it is driven from its closed position to its open position; flame sensing means operable when a pilot flame is sensed during said time interval to maintain said pilot valve operated after the end of said time interval, and second switching means operated at the end of said time interval to effect the deenergization of said pilot valve if a pilot flame fails to be sensed during said time interval.

2. A system as set forth in claim 1 wherein said second switching means is operatively coupled to said stack damper means for operation thereby.

3. A system as set forth in claim 1 wherein said second switching means is operable to effect the energization of said main valve solenoid at the end of said time interval when a pilot flame is sensed before the end of said time interval.

4. A system as set forth in claim 2 which further comprises third switching means for effecting the deenergization of said drive motor when the damper plate reaches the fully open position, and said activate switch means thereafter responding to the termination of said request for heat to effect the deenergization of pilot and main valve solenoids and the reenergization of said drive motor, allowing the damper plate to be driven to its closed position.

5. A system as set forth in claim 4 wherein said third switching means comprises a limit switch operated when said damper plate reaches its fully open position to deenergize said first switching means, said flame sensing means preventing the deenergization of said first switching means when a flame fails to be sensed during said time interval and said first switching means preventing the reenergization of said drive motor for heat whenever said first switching means remains energized after said time interval.

6. A system as set forth in claim 1 wherein said flame sensing means responds to a flameout during the period of said request for heat to effect the deenergization of said pilot and main valve solenoids and the reenergization of said drive motor to cause the damper plate to be driven to its closed position, and then to its open position; and said first switching means enabling said pilot valve to be reenergized, during a further trial for ignition defined by the excursion time of the damper plate as it is driven from its closed position to its open position.

7. A system as set forth in claim 1 wherein said flame sensing means comprises third switching means which is normally disabled in the absence of a flame and which is enabled when a flame is sensed during said time interval to complete a holding path for said pilot valve, said first switching means being prevented from responding to said activate switch means whenever said third switching means is enabled at the time said activate switch means operates.

8. A system as set forth in claim 7 wherein said flame sensing means is energized continuously and independently of said activate switch means.

9. In a heating system including a furnace having a fuel-fired burner apparatus, with a solenoid operated pilot valve for supplying fuel to a pilot outlet for ignition by sparks provided by a spark generator to provide a pilot flame; a solenoid operated main valve for supplying fuel to a main burner for ignition by the pilot flame; a vent stack for venting combustion products away from said burner apparatus; and stack damper means including a stack damper plate mounted within said vent stack and movable between closed and open positions under the control of a drive motor; a control circuit for controlling the operation of said fuel valves and said drive motor comprising:

activate switch means operable in response to a request for heat to energize said drive motor to cause said damper plate to be driven from its closed position towards its open position; start switch means responsive to the operation of said activate switch means to complete an energizing path for said pilot valve solenoid and said spark generator during a trial for ignition time interval defined by the excursion time of said damper plate as it is driven from its closed position to its open position, flame sensing means operable when a pilot flame is sensed during said time interval to complete a holding path for said pilot valve, and interrupt switch means operable to interrupt the energizing path for said pilot valve at the end of said time interval whereby said pilot valve solenoid is maintained energized over said holding path, and said pilot valve solenoid being deenergized if said flame sensing means fails to complete said holding path before said interrupt switch means operates.

10. A system as set forth in claim 9 wherein said interrupt switch means includes means operable to connect said main valve solenoid to said holding path for energization thereover at the end of said time interval.

11. A system as set forth in claim 10 wherein said flame sensing means includes flame switch means operated when a flame is sensed to interrupt said energizing path for said pilot valve solenoid, and hold switch means energized over said pilot valve solenoid energizing path and operated prior to the operation of said flame switch means to prepare said holding path for maintaining said pilot valve solenoid energized after said flame switch means operates and completes said holding path.

12. A system as set forth in claim 11 wherein said flame sensing means is energized continuously and independently of said activate switch means.

13. A system as set forth in claim 11 wherein said flame switch means, when operated, interrupts an energizing path for said drive motor, and said interrupt switch means comprises limit switch means for connecting said drive motor to said holding path to maintain said drive motor energized, and for deenergizing the drive motor the damper plate reaches its fully open position.

14. A system as set forth in claim 9 wherein said interrupt switch means comprises limit switch means which is operated to deenergize said drive motor when the damper plate reaches its fully open position.

15. In a heating system including a furnace having a fuel-fired burner apparatus, with a solenoid operated pilot valve for supplying fuel to a pilot outlet for ignition by sparks provided by a spark generator to provide a pilot flame; a solenoid operated main valve for supplying fuel to a main burner for ignition by the pilot flame; a vent stack for venting combustion products away from said burner apparatus; and stack damper means including a stack damper plate mounted within said vent stack and movable between closed and open positions under the control of a drive motor; a control circuit for controlling the operation of said fuel valves and said drive motor comprising: activate switch means operable in response to a request for heat to effect the energization of said drive motor over a first circuit path to cause said damper plate to be driven from its closed position to its open position; start switch means operable to complete a second circuit path for energizing said pilot valve solenoid and said spark generator; flame sensing means including flame switch means which is normally disable in the absence of a flame and which is enabled when a flame is sensed to interrupt said first and second circuit paths; hold switch means energized over one of said circuit paths and operated prior to the operation of said flame switch means to complete a third circuit path over which said drive motor is maintained energized after said flame switch means operates to interrupt said first circuit path, and said flame switch means being operable when enable to connect said pilot valve solenoid to said third circuit path for maintaining it energized after said flame switch means operates to interrupt said second circuit path; and limit switch means including a limit switch operable to deenergize said drive motor when the damper plate reaches its fully open position.

16. A system as set forth in claim 15 wherein said limit switch means comprises a further limit switch operable to effect the de-energization of said start switch means when said damper plate reaches its fully open position, said flame switch preventing the de-energization of said start switch means whenever a flame fails to be sensed during said time interval.

17. A system as set forth in claim 15 wherein said start switch means responds to said activate switch means to energize said pilot valve solenoid and said spark generator as said damper plate is driven from its closed position to its open position, said limit switch means including a further limit switch operable to disconnect said pilot valve solenoid from said second circuit path at the end of a trial for ignition interval, effecting the de-energization of said pilot valve solenoid whenever said pilot valve solenoid fails to be connected to said third circuit path before said further limit switch operates.

* * * * *